United States Patent [19]

Virr

[11] Patent Number: 4,465,022

[45] Date of Patent: Aug. 14, 1984

[54] FLUIDIZED BED RETROFIT BOILER

[76] Inventor: Michael J. Virr, 580 Franklin, North Muskegon, Mich. 49445

[21] Appl. No.: 401,284

[22] Filed: Jul. 23, 1982

Related U.S. Application Data

[63] Continuation of Ser. No. 399,961, Jul. 19, 1982, abandoned.

[51] Int. Cl.[3] ..... F22B 1/02

[52] U.S. Cl. ..... 122/4 D; 110/210; 110/214; 110/245

[58] Field of Search ..... 110/245, 210, 214, 263, 110/347; 122/4 D

[56] References Cited

U.S. PATENT DOCUMENTS

| | | | |
|---|---|---|---|
| 3,625,164 | 12/1971 | Spector | 122/4 D |
| 3,808,986 | 5/1974 | Logdon | 110/210 |
| 3,866,551 | 2/1975 | Sanga | 110/210 |
| 3,890,935 | 6/1975 | Moss et al. | 122/4 D |
| 4,027,602 | 6/1977 | Mott | 110/216 |
| 4,080,910 | 3/1978 | Jaccoud | 110/210 |
| 4,213,405 | 7/1980 | Lis et al. | 122/2 |
| 4,267,801 | 5/1981 | Robinson | 122/4 D |
| 4,268,244 | 5/1981 | Dawson | 122/4 D |
| 4,273,073 | 6/1981 | Robinson | 122/4 D |
| 4,279,222 | 7/1981 | Pearce | 122/4 D |
| 4,296,711 | 10/1981 | Bilberg | 122/2 |

FOREIGN PATENT DOCUMENTS

| | | | |
|---|---|---|---|
| 1475991 | 6/1977 | United Kingdom | 110/245 |
| 2088237 | 6/1982 | United Kingdom | 110/245 |

OTHER PUBLICATIONS

Kaplan, *Coal Combustor Retrofits to Gas and Oil Fired Boilers,* Chem. Eng., Feb. 22, 1982, vol. 89, No. 4.

*Primary Examiner*—Edward G. Favors

*Attorney, Agent, or Firm*—Price, Heneveld, Huizenga & Cooper

[57] ABSTRACT

A boiler is adapted for solid-fuel firing by connecting with an existing combustion chamber of the boiler. Apparatus comprising a bed of particles with means for feeding solid fuel and primary air to the bed. Secondary air is fed to the existing combustion chamber of the boiler with heated gases which leave the bed.

6 Claims, 1 Drawing Figure

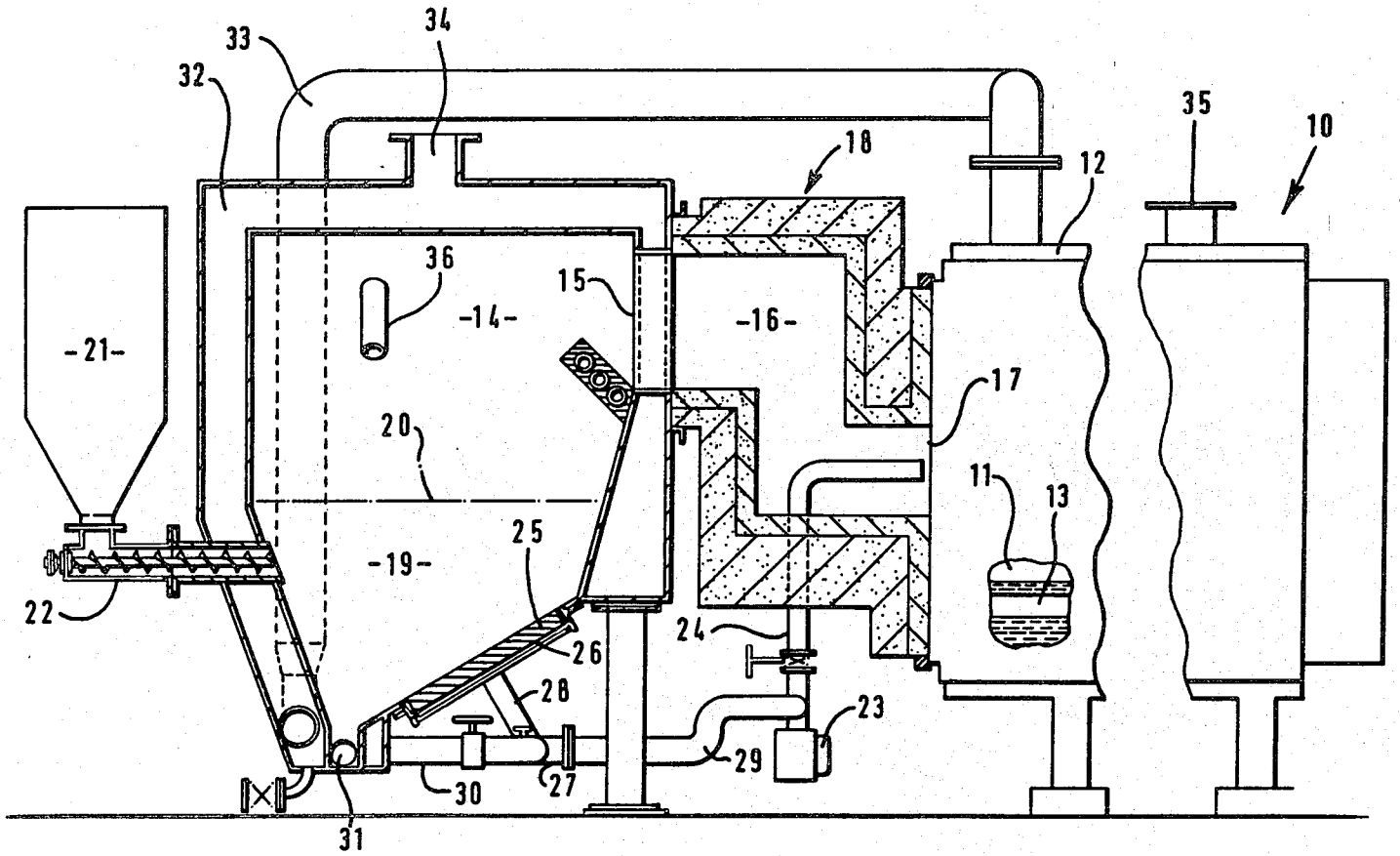
10
35
12
13
11
17
18
-16-
23
24
29
15
26
25
28
27
30
-14-
36
20
-19-
34
31
33
32
-21-
22

FLUIDIZED BED RETROFIT BOILER

RELATED APPLICATION

This is a continuation application of parent application Ser. No. 399,961 entitled IMPROVEMENTS RELATING THE BOILERS, filed July 19, 1982 abandoned.

SUMMARY OF THE INVENTION

From one aspect, the present invention relates to a method of adapting for solid-fuel firing a boiler fitted with a burner for fluid-fuel firing. The invention also relates to a method of heating a fluid and to a heater for use in the method.

According to the first aspect of the invention, we provide a method of adapting for solid fuel firing a boiler fitted with a burner for fluid-fuel firing, wherein the burner is removed from the boiler and there is connected with a combustion chamber of the boiler apparatus comprising a bed of particles disposed in a further combustion chamber, fuel feed means for feeding solid fuel to the bed and air feed means for feeding primary air into the bed in a manner to fluidise the bed, provision also being made for feeding secondary air to the combustion chamber of the boiler with gases which emerge from the fluidized bed in use.

The invention enables coal to be gasified in the bed of the further combustion chamber and for the resulting hot combustible gases to be burned in the combustion chamber of the boiler so that the existing heat exchanger of the boiler can be used to extract heat from the products of combustion. Since the rate at which air is admitted to the further combustion chamber can be less than the rate at which air is required for complete combustion of the fuel, the apparatus which is connected with the combustion chamber of the boiler can be of moderate size.

An adapted boiler employing each aspect of the invention will now be described, with reference to the accompanying drawing wherein there is shown partly in vertical cross-section a part of a boiler and apparatus connected with the boiler.

The boiler 10 is generally of known construction and defines a cylindrical combustion chamber 11 arranged with its axis horizontal and surrounded by a generally cylindrical water jacket 12 which forms a part of a heat exchange of the boiler. The heat exchanger further comprises a number of tubes 13 (one only of which is shown) for conveying hot gases through the body of water in the water jacket. The combustion chamber and tubes of the boiler are connected together in a known manner.

At one end of the combustion chamber 11, there is an opening which, in the unmodified boiler, is closed by a burner (not shown). This burner would be arranged for delivering air and a fluid fuel. For example, natural gas or fuel oil, to the combustion chamber 11 to burn therein. To adapt the boiler for solid-fuel firing, the original burner is removed and there is connected in its place the boiler apparatus which defines a second combustion chamber 14.

The combustion chamber 14 has a gas outlet 15 which communicates via a duct 16 with a gas inlet 17 to the combustion chamber 11. The duct 16 and inlet 17 being defined by an adaptor 18 interposed between the two combustion chambers. The adaptor is insulated so that there is no significant cooling of the gases between the gas outlet 15 and the gas inlet 17.

In the combustion chamber 14, there is provided a bed 19 of particles. The level of the surface of the slumped bed is indicated at 20. Initially, the bed 19 may consist of sand or other refractory particles. After a period of operation, the bed may comprise particles of ash and eventually the sand may be lost entirely from the bed. It will be noted that the shape of the lower part of the combustion chamber 14 is such that the bed has a shallower part near to the adaptor 18 and a deeper part remote from the adaptor.

Fuel feed means is provided for feeding particles of coal or other solid fuel into the bed 19. The fuel feed means comprises a hopper 21, from the bottom of which a screw conveyor 22 leads into the bed 19 at a position below the bed surface 20 and at the deeper side of the bed.

Air feed means is provided for feeding primary air into the bed 19 in a manner to fluidise the bed and for feeding secondary air into the combustion chamber 11. The air feed means comprises an electrically driven fan 23 from which a secondary air duct 24 leads through the adaptor 18 to the gas inlet 17 of the combustion chamber 11. It will be noted that the duct 24 terminates at a position in the centre of the gas inlet 17 so that the secondary air will be distributed approximately uniformly throughout gases flowing from the combustion chamber 14 to the combustion chamber 11.

The air feed means further comprises a plate 25 which is inclined to the vertical at an angle of approximately 60 degrees and forms a lower part of the boundary of the combustion chamber 14, being at a level below the bed surface 20 degrees so that the slumped bed rests partly upon the plate 25. The plate 25 is permeable to gases and may be a porous ceramic or a pierced metal plate. At the underside of the plate 25 there is a shallow passage 26 which extends over the entire area of the underside of the plate and which communicates with a fuel gas-air mixing device 27 via a pipe 28. The mixing device 27 is connected to a source of a gaseous fuel, for example a natural gas main or cylinders of liquified petroleum gas and is also connected by an air duct 29 with the fan 23. A branch of 30 of the air duct controlled by a valve extends to an air inlet 31 at the bottom of the combustion chamber 14, where there is an opening through which solid material can be discharged from the bed.

Around the periphery of and over the combustion chamber 14, there is a passage 32. An inlet to the passage 32 which is disposed adjacent to the bottom of the bed 14 is connected with a water outlet of the water jacket 12 by a pipe 33. At the top of the water passage 32 there is a water outlet 34. During operation of the heater, cool water enters the water jacket 12 through an inlet 35, flows through the water jacket and the tubes 13 to the pipe 33, along the pipe to the passage 32 and water leaves the heater through the outlet 34. The particular example of heater illustrated is intended for producing hot water for a space heating system but it will be understood that the term "boiler" is used herein also to refer to apparatus intended for producing steam.

A pilot burner 36 of known construction extends into the combustion chamber 14 at a position above the bed 19 in both the slumped and fluidized conditions. Gaseous fuel is fed to the pilot burner to maintain in the combustion chamber a pilot flame. When the heater is required to be brought into use from cold, gaseous fuel and air are fed through the mixing device 27 and passage 26 to the bed 19 at a rate just sufficient to fluidise the bed. When the gaseous mixture rises above the bed, it is ignited by the pilot flame and combustion occurs adjacent to the surface of the bed. Since the bed is in a fluidised condition, heat is distributed throughout the bed and the temperature of the bed rises to a level at which combustion can occur within the bed.

When the temperature of the bed has reached a value of about 500 degrees C., operation of the screw conveyor 22 is commenced to feed solid fuel into the bed to burn therein. When the temperature of the bed has reached about 700 degrees C., the supply of gaseous fuel to the bed through the plate 25 is discontinued. Operation of valves controlling supply of the gaseous fuel, of the primary air fed to the bed 19 and of the screw conveyor 22 are controlled by a control system (not shown) which includes means for sensing the temperature of the bed and for sensing the existence of the pilot flame.

During heating of the bed 19 by combustion therein of gaseous fuel without operation of the screw conveyor 22, primary air may be fed to the bed 19 at a rate sufficiently high for complete combustion of the gaseous fuel to occur in the bed 19. During normal use of the heater, after the supply of gaseous fuel to the bed has been discontinued, primary air is fed to the bed at a rate which is less than, preferably within the range 20% to 70% of the rate at which primary air would have to be supplied to the bed to ensure complete combustion of the solid fuel in the bed. Accordingly, the solid fuel is partly oxidised in the bed and combustible gases are evolved from the bed to flow through the duct 16 to the combustion chamber 11. These combustible gases carry sensible heat from the combustion chamber 14 to the combustion chamber 11 and burn with secondary air duct 24. The secondary air is supplied at a rate sufficient to ensure complete combustion of the fuel within the heater.

The rate of feed of solid fuel and air can be varied within a range having limits with a ratio of approximately 2:1, in accordance with the required rate of heat output.

Known devices may be used in conjunction with the heater to remove from flue gases fine solid particles entrained in the gases leaving the heater. Since combustion of liquid and gaseous fuels does not produce such particles, it would generally be necessary to add the means for removing particles from the flue gases during modification of the boiler.

It will be noted that the part of the screw conveyor 22 which is adjacent to the bed 19 extends through the water passage 32 so that excessive heating of the screw conveyor and coal disposed therein is avoided.

Air may be admitted to the combustion chamber 14 through the air inlet 31 intermittently, when the discharge of incombustible resides from the bed is necessary.

I claim:

1. A method of adapting for solid-fuel firing a boiler having a combustion chamber with an opening for normally receiving a fluid fuel burner, comprising the steps of attaching to said boiler at said opening and upstream of said combustion chamber, (a) a fluidized bed combustion chamber, (b) solid fuel feed means for feeding solid fuel to the fluidized bed, (c) primary combustion air feed means for feeding primary combustion air to the fluidized bed, and (d) secondary combustion air feed means adjacent said opening for feeding secondary combustion air to said first mentioned combustion chamber with gases emerging from said fluidized bed combustion chamber.

2. The method in claim 1 including the step of regulating the degree of combustion of fuel in said fluidized bed combustion chamber to less than complete combustion by restricting the primary combustion air thereto.

3. The method in claim 2 wherein the primary combustion air is restricted to an amount in the range of 20% to 70% of that required for complete combustion in said fluidized bed combustion chamber.

4. A boiler assembly comprising, in combination with a boiler having a combustion chamber and an opening for normally receiving a fluid fuel burner; (a) a fluidized bed boiler chamber upstream of said opening and having its discharge into said opening, (b) solid fuel feed means for feeding said fuel into said fluidized bed, (c) primary combustion air feed means for feeding primary combustion air to the fluidized bed, and (d) secondary combustion air feed means adjacent said opening for feeding secondary combustion air to the gases emerging from said fluidized bed combustion chamber and flowing into said first mentioned combustion chamber.

5. The boiler assembly in claim 4 including an adaptor between said opening and said fluidized bed boiler chamber.

6. The boiler assembly in claim 5 wherein said fluidized bed boiler chamber has a shallower part near said adaptor and a deeper part remove from said adaptor.

* * * * *